US005901170A

United States Patent [19]

Peysakhovich et al.

[11] Patent Number: 5,901,170

[45] Date of Patent: May 4, 1999

[54] INDUCTION FURNACE

[75] Inventors: Vitaly A. Peysakhovich, Moorestown; Benno J. Box, Willingboro; John H. Mortimer, Mt. Laurel, all of N.J.

[73] Assignee: Inductotherm Corp., Rancocas, N.J.

[21] Appl. No.: 08/846,825

[22] Filed: May 1, 1997

[51] Int. Cl.[6] ..... H05B 6/22

[52] U.S. Cl. ..... 373/155; 373/151; 373/152

[58] Field of Search ..... 373/151, 152, 373/153, 155, 156; 219/634, 679; 335/302; 428/551

[56] References Cited

U.S. PATENT DOCUMENTS

| | | | |
|---|---|---|---|
| 1,879,361 | 9/1932 | Linnhoff . | |
| 4,580,273 | 4/1986 | Crescenzi | 373/151 |
| 4,969,158 | 11/1990 | Larson et al. | 373/152 |
| 5,416,457 | 5/1995 | Nakatsuka et al. | 335/302 |
| 5,418,069 | 5/1995 | Learman | 428/551 |

FOREIGN PATENT DOCUMENTS

| | | |
|---|---|---|
| 644 657 | 4/1937 | Germany . |
| 784 363 | 10/1954 | United Kingdom . |

*Primary Examiner*—Teresa Walberg
*Assistant Examiner*—Quang Van
*Attorney, Agent, or Firm*—Seidel, Gonda, Lavorgna & Monaco, PC

[57] ABSTRACT

An induction furnace apparatus and method for reducing the magnetic field produced by the operation of the furnace. The induction furnace including a refractory vessel, an induction coil, and an outer shell having a layer of metallic and magnetically permeable material. The metallic and magnetically permeable material comprising a plurality of elements having a shape and size that is chosen to maximize the packing density of elements throughout the layer. The outer shell further including a top, base, and sidewall arranged about the refractory vessel such that the metallic and magnetically permeable material is formed between the refractory vessel and the outer shell. The invention provides a method for casting metallic and magnetically permeable material with or without a non-conductive matrix. The castings can be formed into inserts or incorporated into the top, base, and side wall of the outer shell. The invention includes inserts comprising metallic and magnetically permeable material located in a space formed between the refractory vessel and the outer shell.

16 Claims, 4 Drawing Sheets

INDUCTION FURNACE

FIELD OF THE INVENTION

The present invention pertains to induction furnace design. The invention provides an induction furnace having a surrounding layer of metallic and magnetically permeable material for the reduction of magnetic fields generated by the operation of an induction furnace.

BACKGROUND OF THE INVENTION

An induction furnace employs electromagnetic energy to induce electrical currents to flow within a charge of metal or metal alloy. The electrical resistance of the metal produces heat as a natural consequence of the induced currents flowing in the metal. The combination of applied electrical power and frequency can be chosen to create sufficient heat within the metal to cause it to melt. The molten metal can then be poured into molds or otherwise used to produce a wide variety of metal products.

The basic elements of an induction furnace include an electro-magnetic induction coil, a vessel having a lining of refractory material, and a structure for supporting the induction coil and vessel. The induction coil comprises an electrical conductor of sufficient size and current capacity to produce the magnitude of magnetic flux necessary to induce large currents in the metal charge. The magnetic flux represents the lines of force of a magnetic field. The magnetic field emanates from the furnace and surrounds the adjacent work area occupied by operating personnel and equipment.

There is a need to reduce the magnetic fields produced by the operation of induction furnaces. Although the health consequence resulting from exposure to magnetic fields is unknown, it is deemed prudent to provide a design and method for magnetic field reduction. However, it is well known that EMI (electromagnetic interference) can cause failure or destruction of electronic equipment resulting from exposure to high energy magnetic fields. Therefore, there is a need to protect operating personnel and equipment from magnetic field exposure caused by the operation of an induction furnace.

SUMMARY OF THE INVENTION

The present invention is an induction furnace apparatus and method for reducing magnetic fields produced by an induction coil during operation of the furnace. The induction furnace comprises a refractory vessel having an induction coil, and an outer shell having a layer of metallic and magnetically permeable material for reducing the magnetic fields generated by the induction coil.

The outer shell has components including a top, a base, and a side wall which are arranged about the vessel and substantially enclose it. The components are located in proximity to the vessel and may form a space between the vessel and the outer shell. The top, base, and sidewall have a layer of metallic and magnetically permeable material in proximity to the magnetic fields produced by the conduction coil.

In a preferred embodiment of the invention the metallic and magnetically permeable material is fabricated into forms that are cast and encapsulated in a non-conductive refractory or insulator. The casted forms are either located alongside or incorporated into the top, base, and sidewalls of the outer shell. The base is used to support the outer shell components, induction coil, and refractory vessel.

The metallic and magnetically permeable material includes, but is not limited to, discrete elements having a uniform or random size and shape. The material is located within, or in proximity with, the outer shell and functions to reduce the intensity of the magnetic field external to the outer shell. This is accomplished by retaining, absorbing, dissipating, and shunting to ground the magnetic field energy within the structure of the furnace.

In a preferred embodiment of the invention, the metallic and magnetically permeable material is cast into the top, base, and the side wall. In another preferred embodiment, the metallic and magnetically permeable material is cast into inserts that are located in close proximity to the interior surfaces of the top, base, and the side wall. In yet another preferred embodiment, the metallic and magnetically permeable material is cast into the top and base, and an insert is located in close proximity to the interior surface of the side wall. Inserts are made by casting the metallic and magnetically permeable material in a non-conductive matrix. In addition, the metallic and magnetically permeable material that is cast into the top, base, and the side wall may be encapsulated with a non-conductive matrix.

The components of the outer shell, including the metallic and magnetically permeable material, are preferably made by casting. However, it is understood that the components of the invention can be formed by any commercially available process. During manufacture, a non-conductive matrix can be applied, if at all, to the components before, during, or after they are formed. In addition, the components of the invention may have either metallic or magnetically permeable material, or both, in a proportion necessary to achieve the required reduction in externally generated magnetic fields.

In a preferred embodiment of the invention, the side wall insert is substantially cylindrical and conforms to the interior space formed by the outer shell and the induction coil. However, it is understood that the furnace, outer shell and side wall insert can be formed in any shape. The inserts may also be located away from the induction coil as necessary to reduce the intensity of the magnetic flux entering the metallic and magnetically permeable material.

The discrete elements of the metallic and magnetically permeable material are arranged in such a manner to produce a maximum packing density. In a preferred embodiment, the discrete elements of the metallic and magnetically permeable material have a substantially spherical shape and are of a uniform size. However, the size of the discrete elements can also be random. The discrete elements are arranged to maximize their packing density within the outer shell's components or inserts.

The preferred arrangement for the spherically shaped discrete elements is in a hexagonal closest packing. Packing density is further enhanced by the application of vibration and pressure during fabrication. The ratio of spherical elements to insulating material is adjusted according to the material composition selected and the amount of magnetic field reduction necessary. For example, silicone insulating material will have a preferred ratio of 80 percent spherical elements to 20 percent silicone. Refractory insulators will have a preferred ratio of 70 percent spherical elements to 30 percent refractory insulators. These percentages reflect preferred packing densities which also provide satisfactory structural integrity of the discrete elements after vibration. It is preferred, but not essential, that the metallic and magnetically permeable materials have low silicone content.

The size of the discrete elements is also an important factor in reducing the intensity of the magnetic field strength generated by the induction furnace. Typically, magnetic field strength is inversely proportional to element size and permeability. For example, the reduction of the magnetic field strength can be achieved by increasing the diameter and/or the permeability of spherically shaped discrete elements. In addition, permeability can be further increased by the selection of materials having high permeability.

Spherically shaped elements are preferred because they tend to produce the greatest reduction in magnetic field strength. In addition, discrete elements having a uniform size are preferred because they tend to produce the most efficient element packing arrangements. Although elements having a nonuniform size and shape can be used, they may not produce the most efficient element packing arrangements. However, in another embodiment of the invention, large spheres are mixed with smaller spheres. This is done to increase the packing density of the larger elements which should result in higher overall permeability within the outer shell components or insert.

DESCRIPTION OF THE DRAWINGS

For the purpose of illustrating the invention, there are shown in the drawings forms which are presently preferred; it being understood, however, that this invention is not limited to the precise arrangements and instrumentalities shown.

DESCRIPTION OF THE INVENTION

Figure 1:
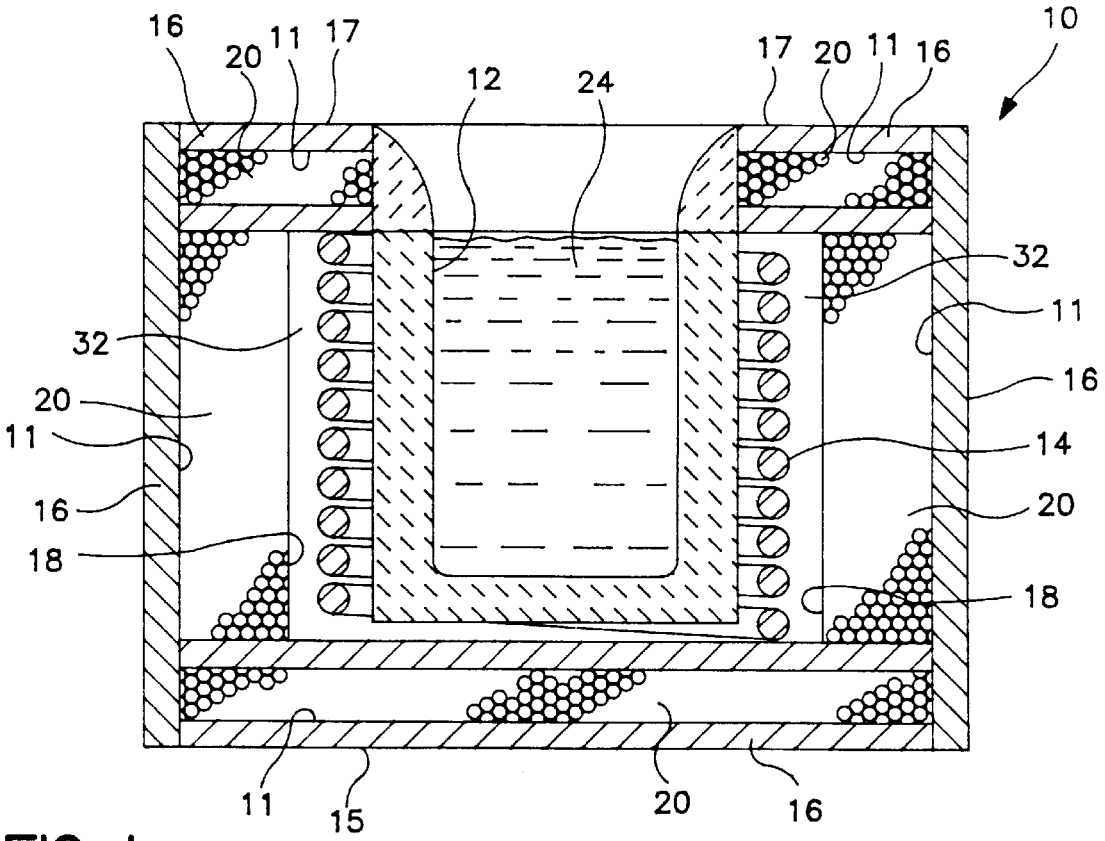
FIG. 1 is a vertical longitudinal section of an induction furnace according to one embodiment of the invention, illustrating the vessel, induction coil, space, insert, outer shell, base and top of the furnace.

Referring to the drawings, wherein like numerals indicate like elements, FIG. 1 illustrates an induction furnace 10 which embodies the present invention. The induction furnace 10 has a refractory vessel 12, an induction coil 14, and an outer shell 16 substantially enclosing the refractory vessel 12. The outer shell 16 comprises a layer of metallic and magnetically permeable material 20 between the outer shell 16 and the induction coil 14. In a preferred embodiment, the outer shell 16 substantially encloses the refractory vessel 12 and the induction coil 14, and the outer shell 16 further comprises a refractory top 17, an inner side wall 11, and a refractory base 15. The inner side wall 11 can be made of a conductive or non-conductive refractory or silicone material, or a metallic material.

Induction furnaces are typically cylindrical in shape, as shown in FIG. 1. However, details of the supporting structure including the shape of the furnace are not crucial to the invention and may vary from one furnace to another. Therefore, it is to be understood that the details shown in the figures are representative of a preferred embodiment only, and that other embodiments, including those that are square, oval or triangular, are possible.

Referring to FIG. 1, in a preferred embodiment, the induction coil 14 is substantially enclosed by the outer shell 16, an insert 18, the inner side wall 11, the refractory base 15, the refractory top 17, and outer shell 16. The outer shell 16 refers to an outer structure enclosing the furnace 10. The insert 18 comprises metallic and magnetically permeable material 20. In addition, the refractory base 15 and refractory top 17 include a layer of magnetically permeable material 20. The metallic and magnetically permeable material 20 serves to retain the electromagnetic flux generated by the induction coil 14 during operation of the furnace 10.

Figure 2:
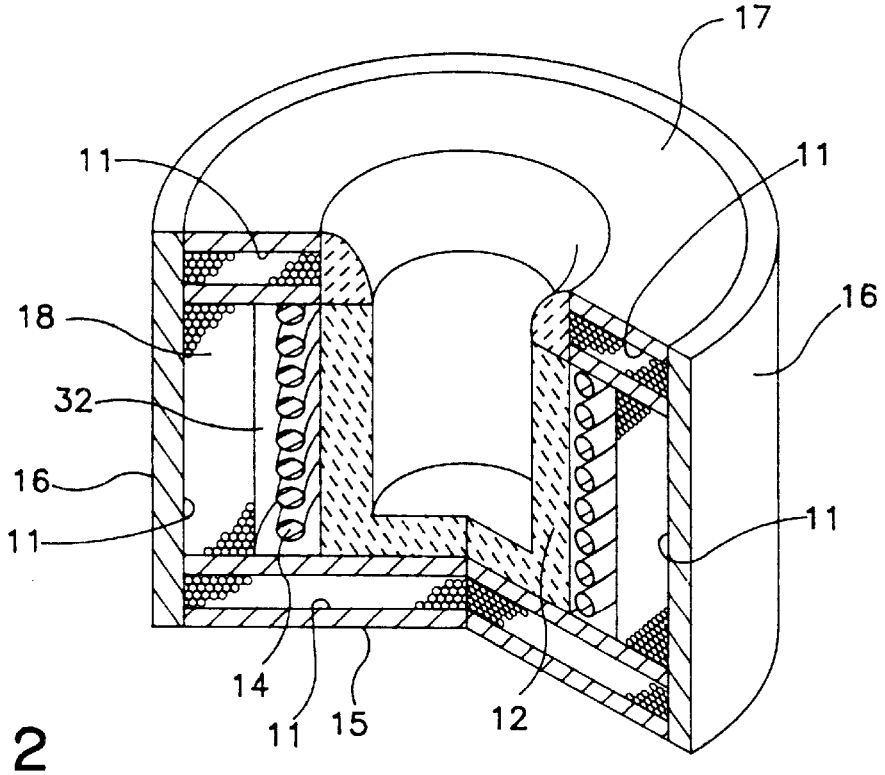
FIG. 2 is an exposed isometric view of the embodiment illustrated in FIG. 1.

Referring to FIG. 2, the metallic and magnetically permeable material 20 is cast into an insert 18, the inner side wall 11, the refractory base 15, the refractory top 17 and substantially encloses the induction coil 14 and the refractory vessel 12. The induction coil 14 is arranged about the refractory vessel 12. Optionally, a space 32 can be formed between induction coil 14 and the outer shell 16. The base 15 supports the components of the furnace 10 including the outer shell 16, the insert 18, the induction coil 14, and the refractory vessel 12.

In a preferred embodiment, the outer shell 16 is made of a non-conductive refractory material such as, but not limited to, a preformed material like NAD II™, or a castable material such as Fondu™ manufactured by LaFarge Calcium Aluminate, Inc. Alternatively, the outer shell 16 can be made from a low-resistivity metal such as copper or aluminum. The inner side wall 11 can be made of metallic material to further reduce the magnetic field that is not contained by the insert 18.

The purpose of the insert 18 and inner side wall 11 is to contain the magnetic field generated by the induction coil 14 within the interior of the furnace 10. The outer shell 16 provides protection for the coil 14, and provide a means for attachment to the furnace 10 so it can be tilted, or retained and positioned above the ground if necessary.

Figure 3A:
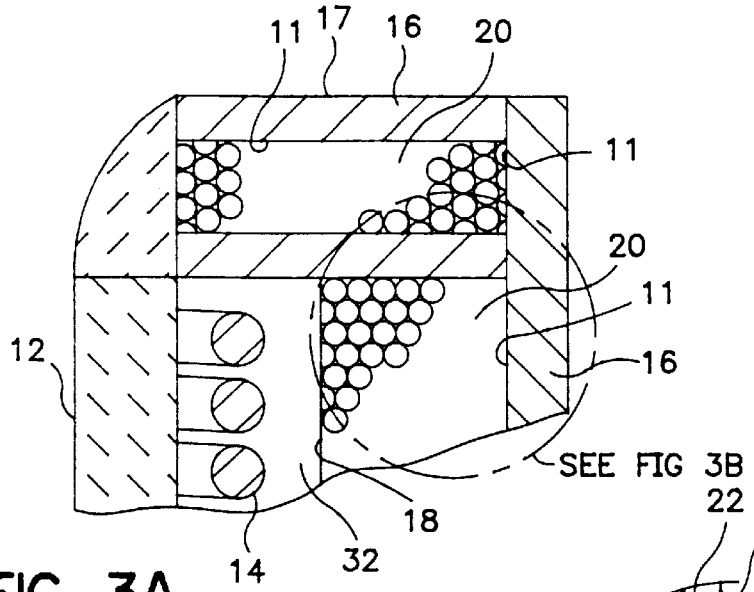
FIG. 3 is a partial longitudinal section of the embodiment illustrated in FIG. 1 showing the outer wall, insert, space, induction coil, and vessel.
Figure 3B:
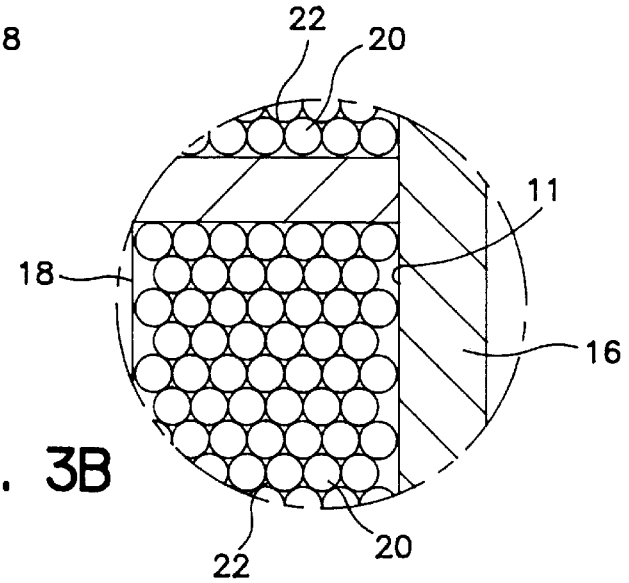

Referring to FIG. 3A, the space 32 formed between the outer shell and the induction coil 14 is occupied by the insert 18. The space 32 can be fully or partially occupied by the insert 18 or the inner side wall 11. In a preferred embodiment, the insert 18 substantially fills the space 32. The insert 18 is made of metallic and magnetically permeable material 20. The material is held together with a non-conductive matrix such as epoxy, refractory, or silicone and cast as a single unit or segment. Although not shown, the insert 18 may comprise a plurality of ring castings stacked one atop another to form a substantially cylindrical body.

Referring to FIG.s 3B and 4, the metallic and magnetically permeable material 20 comprise a plurality of discrete elements 22 having a size, shape, and permeability selected as required to reduce the magnetic field produced by the coil 14. In a preferred embodiment, the discrete elements 22 have a substantially spherical shape and size chosen to provide maximum element packing density within a selected volume of space.

In a preferred embodiment of the invention, the metallic and magnetically permeable material 20 is cast into the top 17, base 15, and the inner side wall 11. In another preferred embodiment, the metallic and as magnetically permeable material 20 is cast into inserts that are located in close proximity to the interior surfaces of the top 17, base 15, and the inner side wall 11. In yet another preferred embodiment, the metallic and magnetically permeable material 20 is cast into the top 17 and base 15, and an insert 18 is located in close proximity to the interior surface of the inner side wall 11. Inserts are made by casting the metallic and magnetically permeable material 20 in a non-conductive matrix. In addition, the metallic and magnetically permeable material 20 that is cast into the top 17, base 15, and the inner side wall 11 may be encapsulated with a non-conductive matrix.

The components of the outer shell 16, including the metallic and magnetically permeable material 20, are preferably made by casting. However, it is understood that the components of the invention can be formed by any commercially available process. During manufacture, a non-conductive matrix can be applied, if at all, to the components before, during, or after they are formed. In addition, the components of the invention may have either metallic or magnetically permeable materials, or both, in a proportion that is effective in reducing externally generated magnetic fields.

In a preferred embodiment, the insert 18 is formed by combining spherical metallic and magnetically permeable elements 22 with a non-conductive matrix such as an epoxy or refractory which is then poured and cast in a mold. The top 17 and base 15 are cast in layers into a mold. The layers forming the outer surfaces of the casting are allowed to cure before a layer containing the spherical elements 22 is poured. The spherical elements 22 are combined with a refractory material then mixed and poured on top of the previous layer in the mold. The mold is the vibrated to compact and stack the spherical elements 22. Additional material is added during this process to achieve a desired thickness and packing of the spherical elements 22. A final layer of refractory material is poured on top of the previous layer in the mold to achieve the ultimate thickness of the top 17 and base 15. The refractory is then hardened in a kiln according to standard commercial practice.

The refractory material used to form the insert 18, top 17, and base 15 is silicone-based material such as calcium aluminate refractory materials, or CAC 801-1010 manufactured by EMS. Inc. Spherical metallic and magnetically permeable elements 22 are made of materials such as cast shot. The elements are treated with a silicone adherent, typically a silicone polymer in solvent, and allowed to dry. The spherical elements are then combined with the silicone refractory in proportions of about 80 percent spherical elements to 20 percent silicone. It is understood that any proportion of spherical elements to silicone can produce a reduction in magnetic field. Therefore, the proportion of spherical elements to silicone, or refractory, is dependant upon the desired reduction in magnetic field and can range from 1 to 100 percent. The silicone refractory formulation is placed into a mold and packed by vibration and pressure. Additional material can be added as the spherical elements compact.

Figure 4:
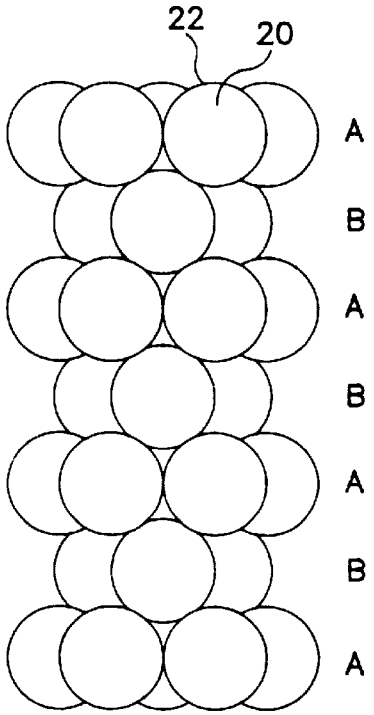
FIG. 4 illustrates a preferred arrangement of discrete elements of metallic and magnetically permeable material in a hexagonal closest packed symmetry.

Referring to FIG. 4, an important feature of the magnetically permeable material 20 is the packing density of the spherical elements 22. Packing density is dependant on by the encapsulating material as given in the above ratios. These ratios allow the highest possible densities while still preserving a useable strength in the molded components. The most efficient and preferred arrangement is a hexagonal closest packing which is illustrated in FIG. 4.

Figure 5:
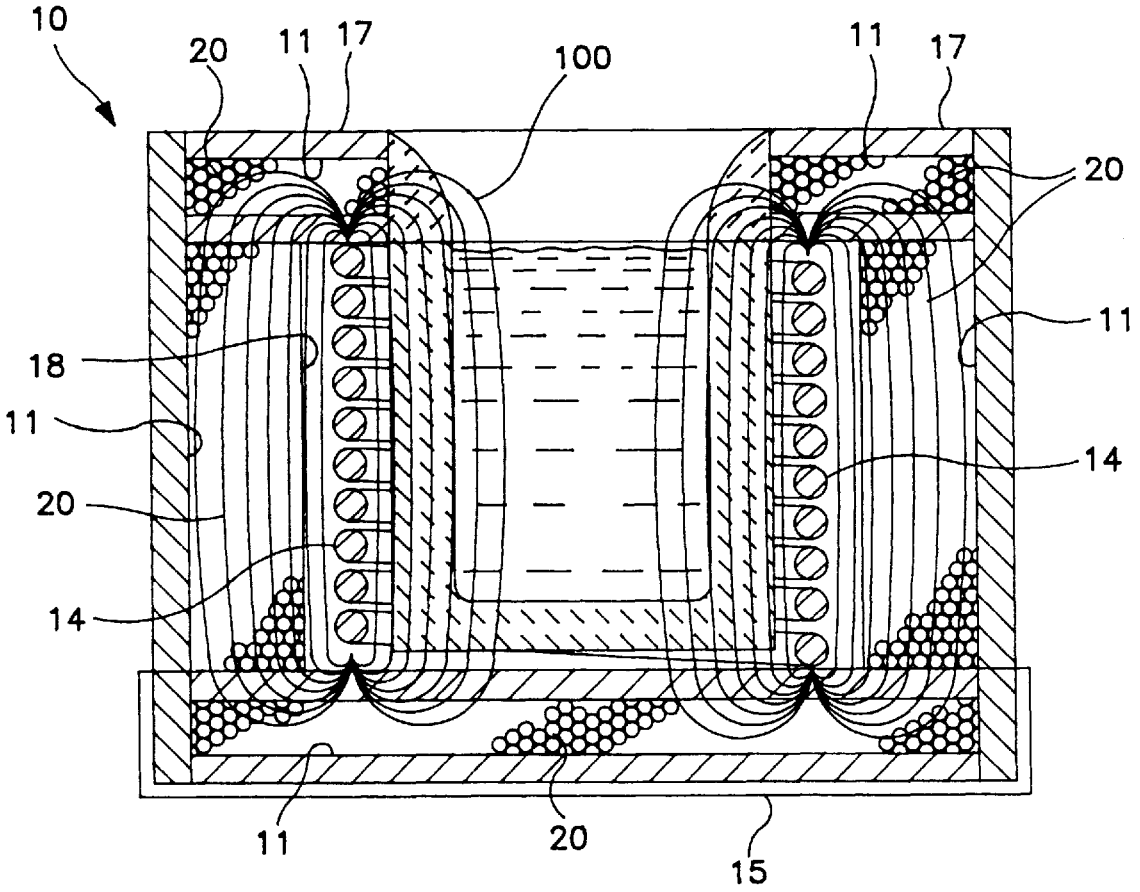
FIG. 5 is a vertical longitudinal section of the embodiment illustrated in FIG. 1 showing magnetic lines of flux produced by the coil.

Referring to FIG. 5, when properly constructed the spherical metallic and magnetically permeable elements 22 contained in the insert 18, top 17, and base 15 will substantially retain the magnetic field produced by the furnace 10. The magnetic field is illustrated by the magnetic flux lines 100 which are generated by current excitation in the induction coil 14. The magnetic flux lines 100 are attracted to and substantially contained by the metallic and magnetically permeable material 20.

Figure 6:
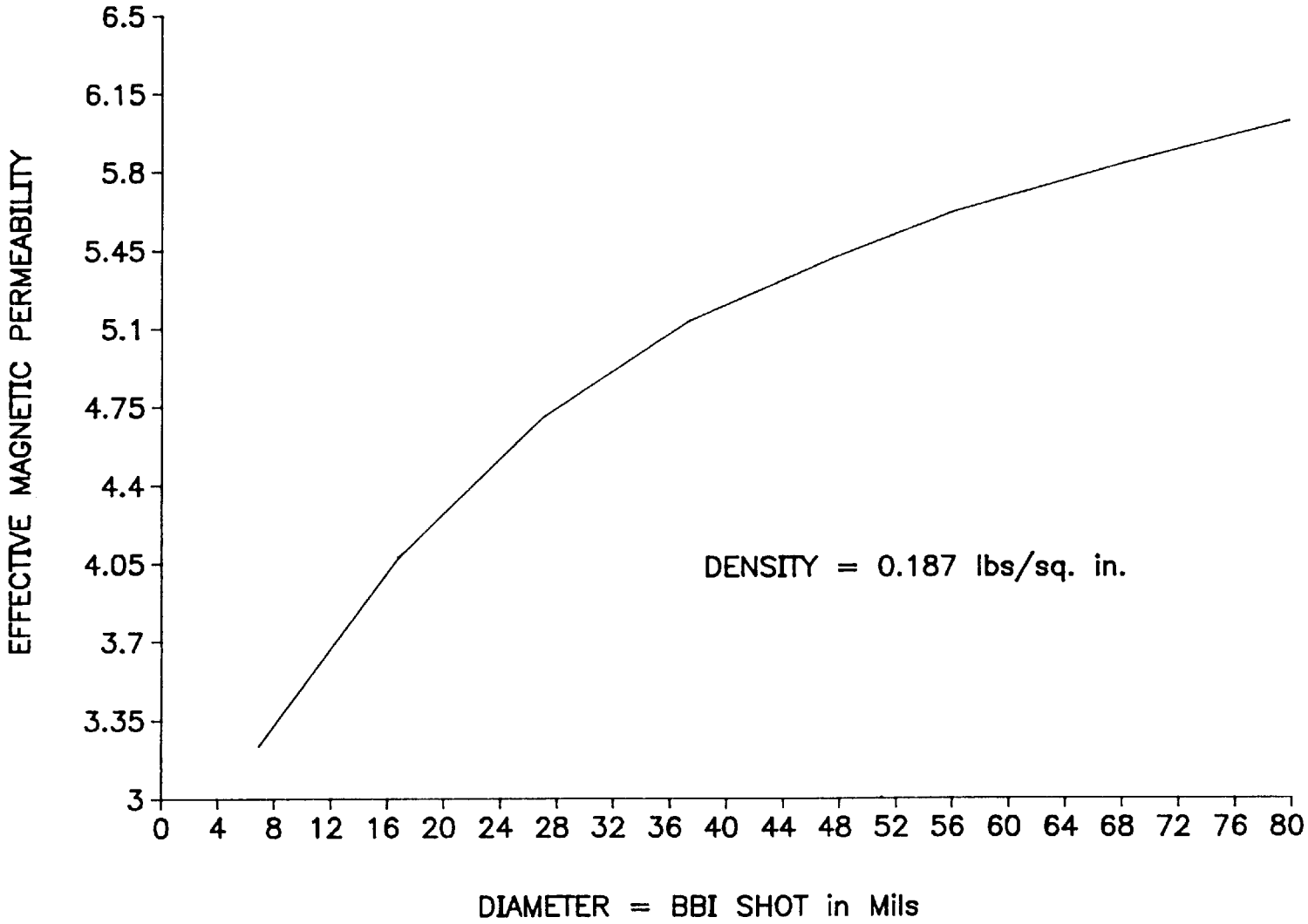
FIG. 6 is a graphical illustration showing the relationship between magnetically permeable material and discrete element size.

The space 32 formed between the outer shell 16 and the induction coil 14 may vary in volume depending on the volume and shape of the furnace 10. The size of the insert is also determined by the amount of magnetic field reduction required and the type of magnetically permeable material used in constructing the insert. The relative permeability for a given element size and material density is defined according to Eq. (1), and the results of which are shown in graphical form in FIG. 6.

$$\mu(d,\rho) = 3.5 + \ln\left[\frac{10\cdot d - 100}{100}\cdot 0.9 + \sqrt{\left(\frac{10\cdot d - 100}{100}\cdot 0.9\right)^2 + 1}\right]\cdot 2.3\cdot\sqrt{\rho} \qquad \text{EQ. 1}$$

where, $\mu(d,\rho)$=relative permeability of material for given element size and material density d=Diameter of elements (in mills)

ρ=Density of compound (lbs/cu. in)

The present invention may be embodied in other specific forms without departing from the spirit or essential attributes thereof and, accordingly, reference should be made to the appended claims, rather than to the foregoing specification, as indicating the scope of the invention.

We claim:

1. An induction furnace having a refactory vessel, an induction coil and supporting structure for the vessel and coil, comprising a layer of metallic and magnetically permeable material between the supporting structure and enclosing the vessel and coil.

2. The induction furnace according to claim 1, wherein the side wall has a substantially cylindrical shape about the longitudinal axis of the refactory vessel, and the top and base are substantially disk shaped.

3. The induction according to claim 1, wherein the metallic and magnetically permeable material of the side wall comprises laminated metallic and magnetically permeable material.

4. The induction furnace according to claim 1, wherein the metallic and magnetically permeable material comprises a plurality of elements.

5. The induction furnace according to claim 4, wherein the elements have a substantially spherical shape.

6. An induction furnace having a refactory vessel, and induction coil, and an outer shell substantially enclosing the vessel and coil, the outer shell comprising a top, a base, and a side wall therebetween, the outer shell having a layer of metallic and magnetically permeable material.

7. The induction furnace according to claim 6, wherein the outer shell is electrically non-conductive.

8. The induction furnace according to claim 6, wherein side wall has a substantially cylindrical shape about the longitudinal axis of the refactory vessel, and the top and base are substantially disk shaped.

9. The induction furnace according to claim 6, wherein the metallic and magnetically permeable material of the side wall comprises laminated metallic and magnetically permeable material.

10. The induction furnace according to claim 6, wherein the metallic and magnetically permeable material comprises a plurality of elements.

11. The induction furnace according to claim 10, wherein the elements have a substantially spherical shape.

12. An induction furnace having a refactory vessel, and induction coil, and supporting structure for the vessel and coil, comprising a top insert, a base insert, and a side insert therebetween; the top insert, base insert and side substantially surrounding the vessel and coil and having a layer of metallic and magnetically permeable material that is cast within a matrix.

13. The induction furnace according to claim 12, wherein the matrix is electrically non-conductive.

14. The induction furnace according to claim 12, wherein the side insert has a substantially cylindrical shape about the longitudinal axis of the refactory vessel, and the top and bottom inserts are substantially disk shaped.

15. The induction furnace according to claim 12, wherein the metallic and magnetically permeable material comprises a plurality of elements.

16. The induction furnace according to claim 12, wherein the elements have a substantially spherical shape.

* * * * *

UNITED STATES PATENT AND TRADEMARK OFFICE

CERTIFICATE OF CORRECTION

PATENT NO. : 5,901,170
DATED : May 4, 1999
INVENTOR(S) : Peysakhovich et al.

It is certified that error appears in the above-identified patent and that said Letters Patent is hereby corrected as shown below:

In claim 1, col. 6, line 33, after "structure" insert -- and the coil, wherein the layer comprises a top, a base, and a side wall between the top and base, said layer substantially --.

In claim 6, col. 6, line 48, "and" should read -- an --.

In claim 8, col. 6, line 55, after "wherein" insert -- the --.

In claim 12, col. 7, line 1, "and" should read -- an --.

In claim 12, col. 7, line 4, after "side" insert -- insert --.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*